US007434685B2

(12) United States Patent
Martinez et al.

(10) Patent No.: US 7,434,685 B2
(45) Date of Patent: Oct. 14, 2008

(54) STORAGE CASE FOR GOGGLES

(75) Inventors: Patrice Martinez, Le Perray (FR); Gilles Pena, Elancourt (FR); Laurent Preveyraud, Joue-les-Tours (FR)

(73) Assignee: Intertechnique (FR)

( * ) Notice: Subject to any disclaimer, the term of this patent is extended or adjusted under 35 U.S.C. 154(b) by 479 days.

(21) Appl. No.: 10/534,397

(22) PCT Filed: Dec. 3, 2003

(86) PCT No.: PCT/FR03/03576

§ 371 (c)(1),
(2), (4) Date: May 10, 2005

(87) PCT Pub. No.: WO2004/064564

PCT Pub. Date: Aug. 5, 2004

(65) Prior Publication Data

US 2005/0258056 A1 Nov. 24, 2005

(30) Foreign Application Priority Data

Dec. 23, 2002 (FR) ..... 02 16582

(51) Int. Cl.
*B65D 85/38* (2006.01)
*A45C 11/04* (2006.01)

(52) U.S. Cl. ..... 206/316.1; 206/6

(58) Field of Classification Search ..... 206/5, 206/6, 316.1, 316.2; 220/826; 351/158
See application file for complete search history.

(56) References Cited

U.S. PATENT DOCUMENTS

| | | | | |
|---|---|---|---|---|
| 2,710,091 | A | 6/1955 | Stegeman | |
| 2,747,760 | A * | 5/1956 | Jacobson | 206/6 |
| 5,493,349 | A | 2/1996 | Barhydt et al. | |
| 6,039,174 | A | 3/2000 | Rogers | |
| 6,206,217 | B1 * | 3/2001 | Chiang | 206/5 |
| 6,247,471 | B1 | 6/2001 | Bower et al. | |
| 6,675,959 | B1 * | 1/2004 | Chiang | 206/6 |

FOREIGN PATENT DOCUMENTS

| | | | |
|---|---|---|---|
| DE | 103 085 | C | 3/1898 |
| EP | 0 951 847 | A | 10/1999 |
| FR | 1 060 691 | A | 4/1954 |
| JP | 10 129356 | A | 5/1998 |

* cited by examiner

*Primary Examiner*—Bryon P Gehman
(74) *Attorney, Agent, or Firm*—Dean W. Russell; Kristin M. Crall; Kilpatrick Stockton LLP

(57) ABSTRACT

A storage case for aircraft flight personnel's goggles is provided. The storage case has a case bottom and two doors. Each door has a closure adapted to maintain the goggles in the case between the case bottom and the doors.

16 Claims, 2 Drawing Sheets

Figure 1:
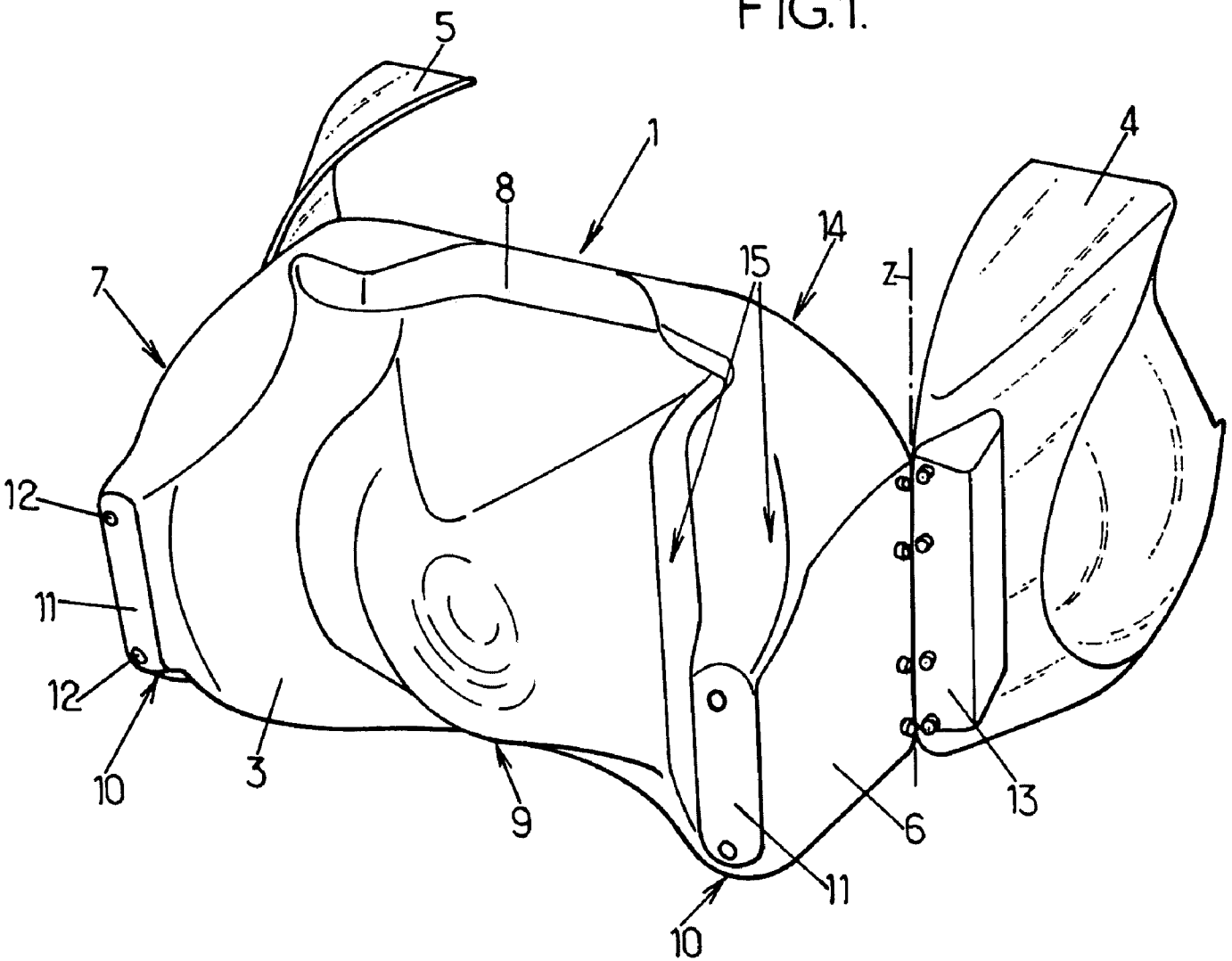

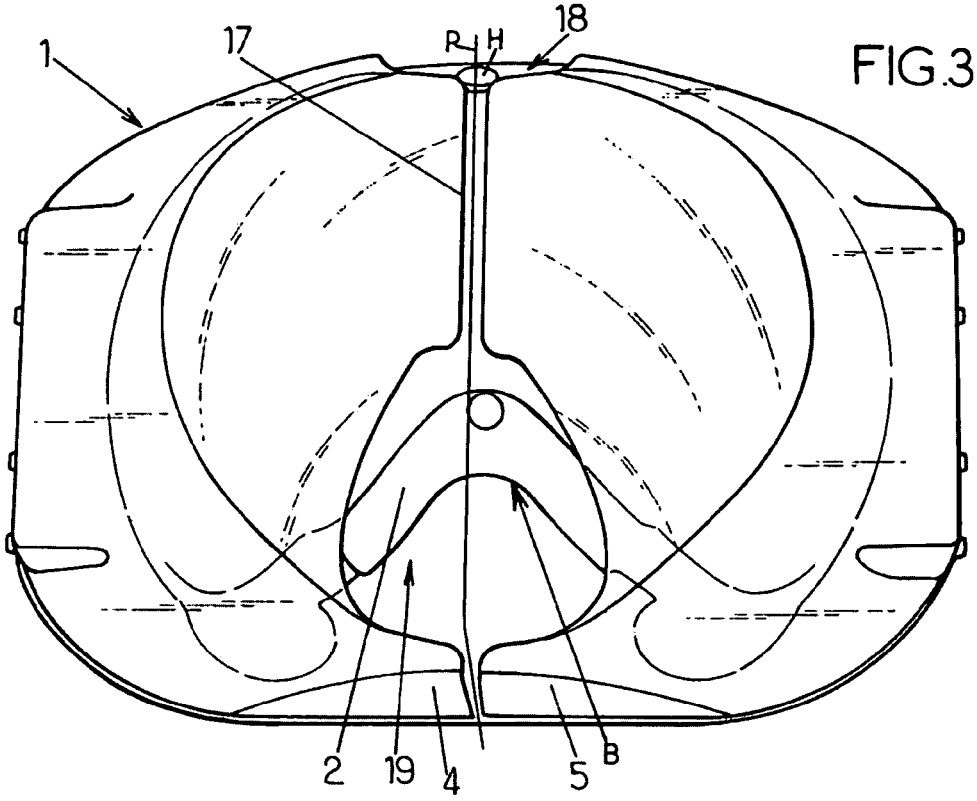
FIG.3
FIG.2.
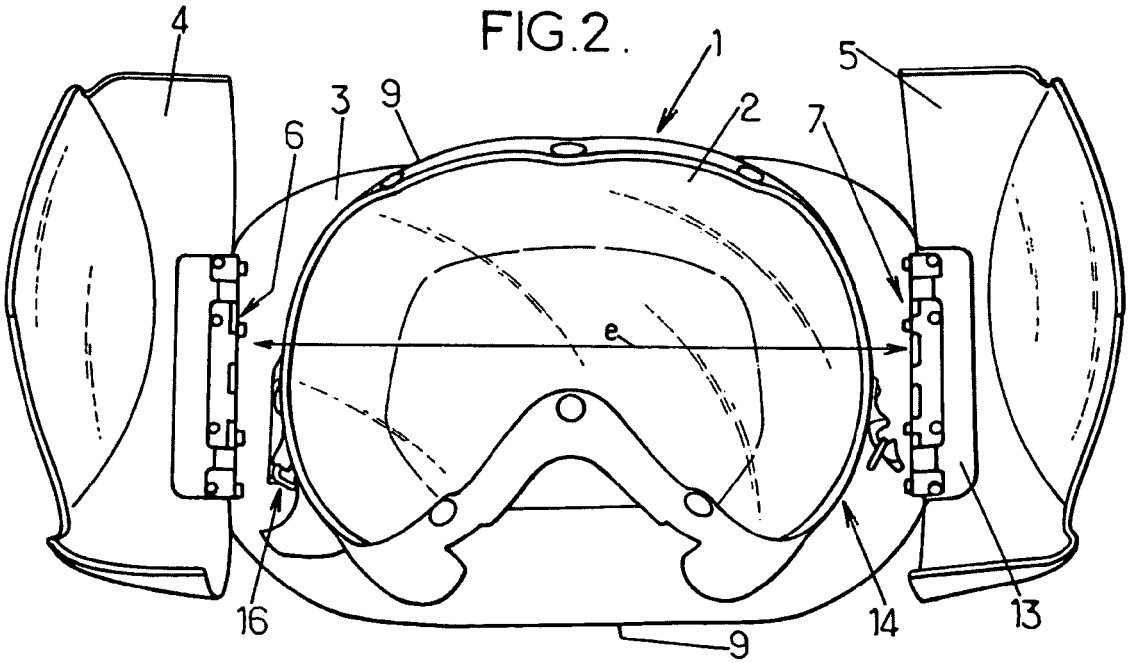

STORAGE CASE FOR GOGGLES

CROSS REFERENCE TO RELATED APPLICATIONS

This application is the U.S. national phase of International Application No. PCT/FR2003/003576 filed on Dec. 3, 2003, which application claims priority to French Patent Application No. 02/16,582 filed on Dec 23, 2002, the contents of which are incorporated by reference herein.

The present invention relates to storage cases for protective goggles, such as smoke protection goggles, for aircraft flight personnel.

More particularly, the invention concerns a case of this type which comprises a case bottom and at least two doors. These two doors have closure means designed to hold the goggles in the case, between the case bottom and the doors. These doors are articulated on the case bottom between at least two end positions: a closed position in which these doors at least partially cover the goggles, and an open position in which the doors are spaced apart from one another to allow the goggles to be removed from the case.

By virtue of these arrangements, the case is able to store goggles and at least partially protect them when their use is not required.

In preferred embodiments of the invention, recourse may also be had to one and/or other of the following arrangements:

- the closure means are composed of mono-stable hinges, with a stable position of the hinges corresponding to the closed position of the doors and designed to hold the goggles in the case even if the goggles are not held by the case bottom;
- the doors are articulated on the case bottom by means of bi-stable hinges, with a first stable position corresponding to the closed position of the doors and designed to hold the goggles in the case even if they are not held by the case bottom, and a second stable position corresponding to the open position of the doors and designed to avoid the doors from closing by themselves.
- the case bottom has a shape designed to hold the protective goggles in the case even when the case is open;
- the case bottom has side walls whose distance from each other is smaller, at least locally, than the width of the goggles;
- the case comprises two doors which are symmetrical with respect to its center plane corresponding to the bilateral plane of symmetry of the goggles; each door has a closure edge which, in the closed position of the doors, approaches the center plane; this closure edge has at least one indentation allowing the goggles to be gripped when they are placed in the case;
- the closure edge of each door has at least one bottom indentation which, when the goggles are in the case, is situated substantially in line with that part of the goggles intended to cover the nose, this bottom indentation, together with the corresponding bottom indentation of the other door, being designed to allow the goggles to be gripped via that part of the goggles intended to cover the nose, and to allow the goggles to be removed from the case with one hand, and without having first opened the doors;
- the closure edge of each door has two indentations, namely a top indentation which, together with the corresponding top indentation of the other door, allows a first finger to be placed on an edge of the goggles, and a bottom indentation which, together with the corresponding bottom indentation of the other door, allows a second finger to be placed on another edge of the goggles, so as to remove the goggles from the case with one hand and without having first opened the doors; and
- the doors are transparent.

Other aspects, aims and advantages of the invention will become evident from reading the description of one of its embodiments.

The invention will also be better understood with the help of the drawings, in which:

- FIG. 1 is a schematic and perspective rear view of an illustrative embodiment of the storage case for goggles according to the invention, with the doors open;
- FIG. 2 is a schematic and perspective front view of the embodiment of the case shown in FIG. 1, with the doors of the case open;
- FIG. 3 is a view analogous to that in FIG. 2, with the goggles in the case and the doors closed.

In the different figures, the same reference numbers designate identical or similar elements.

An illustrative embodiment of the invention is described in detail below.

This embodiment concerns a case 1 for storage of protective goggles 2 for aircraft flight personnel. This case 1 is generally placed in an airplane cockpit. The goggles 2 are, for example, smoke protection goggles.

As is shown in FIG. 1, this case 1 comprises a case bottom 3 and two doors 4 and 5. In alternative forms, the case 1 could have a greater number of doors, for example four doors arranged symmetrically with respect to the diagonals, etc. The doors 4, 5, considered from outside the case 1 when the doors 4, 5 are closed, are substantially convex. The doors 4, 5 are transparent; this makes it possible to verify the presence of the goggles 2 in the case 1 and to check the state of the lens part of these goggles 2.

The case bottom 3 has a substantially rectangular shape, with two side walls 6 and 7, an upper wall 8, and a lower wall 9. These four walls, namely the side walls 6, 7, upper wall 8, and lower wall 9, extend substantially perpendicularly from the case bottom 3 and delimit an open and substantially rectangular face 14.

The case bottom 3 comprises two feet 10. Each foot 10 has a surface 11 which is adjacent to and substantially perpendicular to a side wall 6 or 7. This surface 11 has two holes 12 designed for fixing the case on a support such as a dividing wall in a cockpit, within reach of the flight personnel.

Each side wall is provided with closure means 13. These closure means 13 are, for example, hinges. Each hinge 13 supports a door 4 or 5 and allows the latter to be opened and closed about an axis Z substantially parallel to one of the small sides of the open face 14. The doors 4, 5 are articulated on the case bottom 3 between at least two end positions: a closed position in which the doors 4, 5 at least partially cover the goggles 2 (see FIG. 3), and an open position in which the doors 4, 5 are spaced apart from one another to allow the goggles 2 to be removed from the case 1 (see FIGS. 1 and 2).

The hinges 13 are bi-stable. They have a first stable position corresponding to the closed position of the doors (FIG. 3). In this position, the closure means 13 are designed to hold the goggles 2 in the case 1 with sufficient force, between the case bottom 3 and the doors 4, 5, even if the goggles are not held on the case bottom 3. The hinges 13 have a second stable position corresponding to the open position of the doors 4, 5. This second stable position is designed designed to avoid the doors 4, 5 from closing by themselves. In this way, the user can place the goggles 2 back in the case 1 with just one hand when the doors 4, 5 are open.

As is shown in FIG. 2, the distance e between the side walls 6 and 7 is designed to hold the goggles 2 in the case 1 even when the latter is open. Thus, this distance e is smaller than the dimension of the goggles 2 in width, that is to say parallel to the binocular direction. The case bottom 3 comprises guide surfaces 15 extending from the surfaces 11 to the open face 14 in such a way as to make it easier to insert and lock the side edges 16 of the goggles 2 with sufficient force in the case bottom 3 upon introduction of the goggles 2 into the latter. Thus, a user is able to fit the goggles 2 in the case bottom 3 with one hand, the goggles 2 remaining in position in the latter when the user releases them.

As is shown in FIG. 3, the two doors 4 and 5 are symmetrical with respect to the center plane P of the case corresponding to the bilateral plane of symmetry of the goggles.

Each door 4 or 5 has a closure edge 17 which, in the closed position of the doors 4 and 5, approaches the center plane P. This closure edge 17 has a top indentation 18 and a bottom indentation 19.

The top indentation 18 of one door 4, together with the top indentation of the other door 5, allows a first finger to be placed at a point H on one edge of the goggles. When the goggles 2 are in the case 1, the bottom indentation 19 is situated substantially in line with that part of the goggles 2 intended to cover the nose. The bottom indentation 19 of one door 4, together with the bottom indentation of the other door 5 with which it forms a substantially triangular recess, allows a second finger to be placed at a point B on another edge of the goggles 2. Thus, a user is able to grip the goggles, between points B and H, between two fingers, and is able to withdraw the goggles 2 from the case 3 with one hand. As the convexity of the doors 4 and 5 does not oppose this withdrawal, it is not necessary to have first opened the doors 4 and 5.

The substantially triangular recess formed by the bottom indentations 19, when the doors 4 and 5 are closed, is designed to likewise allow the goggles 2 to be gripped via that part of the goggles 2 intended to cover the nose. This arrangement is especially designed for masks with detachable or removable goggles. As has been explained above, the goggles 2 can be removed from the case 3 with one hand, and without having first opened the doors 4, 5.

The case 1 according to the invention permits storage of several types of smoke protection goggles, while guaranteeing immediate availability of the stored goggles 2. Thus, the goggles stored in the case according to the invention can be fitted on a user's head in less than 15 seconds, as is recommended by legislation.

The invention claimed is:

1. A storage case for protective goggles for aircraft flight personnel, said case comprising a case bottom, and two doors each having closure means designed to hold the goggles in said case, between said case bottom and said doors, said doors being articulated on said case bottom between two end positions a first of which is a closed position in which said doors at least partially cover the goggles, and a second of which is an open position in which said doors are spaced apart from one another to allow the goggles to be removed from said case, wherein said two doors are symmetrical with respect to a center plane of said case, each door having a closure edge which, in said closed position of said doors, approaches said center plane, each closure edge having at least one indentation allowing the goggles to be gripped when the goggles are placed in said case, and wherein said doors are articulated on said case bottom by means of bi-stable hinges having a first stable position corresponding to said closed position of said doors and designed to hold the goggles in said case even if the goggles are not held by said case bottom, and a second stable position corresponding to said open position of said doors and designed to avoid said doors from closing by themselves.

2. The case as claimed in claim 1, wherein said case bottom has a shape designed to hold the goggles in said case even when said case is open.

3. The case as claimed in claim 2, wherein said case bottom has side walls whose distance from each other is smaller, at least locally, than a width of the goggles.

4. The case as claimed in claim 1, wherein said doors are transparent.

5. A storage case for protective goggles for aircraft flight personnel, said case comprising a case bottom, and two doors each having closure means designed to hold the goggles in said case, between said case bottom and said doors, said doors being articulated on said case bottom between two end positions, a first of which is a closed position in which said doors at least partially cover the goggles, and a second of which is an open position in which said doors are spaced apart from one another to allow the goggles to be removed from said case, wherein said two doors are symmetrical with respect to a center plane of said case, each door having a closure edge which, in said closed position of said doors, approaches said center plane, each closure edge having at least one indentation allowing the goggles to be gripped when the goggles are placed in said case, and wherein said closure edge of each said door has at least one bottom indentation which, when the goggles are in said case, is situated substantially in line with a part of the goggles intended to cover a user's nose, said bottom indentation, together with the corresponding bottom indentation of the other door, being designed to allow the goggles to be gripped via said part of the goggles intended to cover the user's nose, and to allow the goggles to be removed from said case with one hand, and without having first opened said doors.

6. The case as claimed in claim 5,wherein said closure means include mono-stable hinges, with a stable position of said hinges corresponding to said closed position of said doors, said hinges being designed to hold the goggles in said case even if the goggles are not held by said case bottom.

7. The case as claimed in claim 5, wherein said doors are articulated on said case bottom by means of bi-stable hinges having a first stable position corresponding to said closed position of said doors and designed to hold the goggles in said case even if the goggles are not held by said case bottom, and a second stable position corresponding to said open position of said doors and designed to avoid said doors from closing by themselves.

8. The case as claimed in claim 5, wherein said case bottom has a shape designed to hold the goggles in said case even when said case is open.

9. The case as claimed in claim 8, wherein said case bottom has side walls whose distance from each other is smaller, at least locally, than the width of the goggles.

10. The case as claimed in claim 5, wherein said doors are transparent.

11. A storage case for protective goggles for aircraft flight personnel, said case comprising a case bottom, and two doors each having closure means designed to hold the goggles in said case, between said case bottom and said doors, said doors being articulated on said case bottom between two end positions, a first of which is a closed position in which said doors at least partially cover the goggles, and a second of which is an open position in which said doors are spaced apart from one another to allow the goggles to be removed from said case, wherein said two doors are symmetrical with respect to a center plane of said case, each door having a closure edge which, in said closed position of said doors, approaches said center plane, each closure edge having at least one indentation allowing the goggles to be gripped when the goggles are placed in said case, and wherein said closure edge of each said door has two indentations, a first of which is a top indentation which, together with the corresponding top indentation of the other door, allows a first finger of a user to be placed on an edge of the goggles, and a second of which is a bottom indentation which, together with the corresponding bottom indentation of the other door, allows a second finger of a user to be placed on another edge of the goggles, so as to remove the goggles from said case with one hand and without having first opened the doors.

12. The case as claimed in claim 11, wherein said closure means include mono-stable hinges, with a stable position of said hinges corresponding to said closed position of said doors, said hinges being designed to hold the goggles in said case even if the goggles are not held by said case bottom.

13. The case as claimed in claim 11, wherein said doors are articulated on said case bottom by means of bi-stable hinges having a first stable position corresponding to said closed position of said doors and designed to hold the goggles in said case even if the goggles are not held by said case bottom, and a second stable position corresponding to said open position of said doors and designed to avoid said doors from closing by themselves.

14. The case as claimed in claim 11, wherein said case bottom has a shape designed to hold the goggles in said case even when said case is open.

15. The case as claimed in claim 14, wherein said case bottom has side walls whose distance from each other is smaller, at least locally, than the width of the goggles.

16. The case as claimed in claim 11, wherein said doors are transparent.

* * * * *